US010670301B1

(12) United States Patent
Waldner

(10) Patent No.: US 10,670,301 B1
(45) Date of Patent: Jun. 2, 2020

(54) MAGNETIC AIR HEATING AN IMPELLING APPARATUS

(71) Applicant: PDS, LLC, Clark, SD (US)

(72) Inventor: Joe Waldner, Clark, SD (US)

(73) Assignee: PDS, LLC, Clark, SD (US)

( * ) Notice: Subject to any disclaimer, the term of this patent is extended or adjusted under 35 U.S.C. 154(b) by 78 days.

(21) Appl. No.: 15/949,773

(22) Filed: Apr. 10, 2018

Related U.S. Application Data

(63) Continuation-in-part of application No. 14/973,921, filed on Dec. 18, 2015, now abandoned.

(51) Int. Cl.

| | |
|---|---|
| ***F04D 29/28*** | (2006.01) |
| ***F24H 3/04*** | (2006.01) |
| ***F04D 17/16*** | (2006.01) |
| ***H05B 6/10*** | (2006.01) |
| ***F04D 29/58*** | (2006.01) |
| *F04D 29/42* | (2006.01) |

(52) U.S. Cl.
CPC ..... *F24H 3/0405* (2013.01); *F04D 17/161* (2013.01); *F04D 29/584* (2013.01); *H05B 6/102* (2013.01); *F04D 29/4206* (2013.01)

(58) Field of Classification Search
CPC ..... H05B 6/108; F04D 17/105; F04D 17/161; F04D 17/162; F04D 29/281; F04D 29/242; F04D 29/5853
See application file for complete search history.

(56) References Cited

U.S. PATENT DOCUMENTS

| | | | | |
|---|---|---|---|---|
| 1,061,142 | A | 5/1913 | Tesla | |
| 2,626,135 | A * | 1/1953 | Serner | B01F 7/0045 366/316 |
| 4,025,225 | A | 5/1977 | Durant | |
| 4,255,081 | A | 3/1981 | Oklejas | |
| 4,403,911 | A * | 9/1983 | Possell | A61M 1/101 415/90 |
| 5,470,197 | A | 11/1995 | Cafarelli | |
| 6,726,443 | B2 * | 4/2004 | Collins | F01D 1/34 415/90 |
| 8,373,103 | B2 | 2/2013 | Waldner | |
| 9,516,703 | B1 | 12/2016 | Nelson | |

* cited by examiner

*Primary Examiner* — Ninh H. Nguyen
(74) *Attorney, Agent, or Firm* — Jeffrey A. Proehl; Woods, Fuller, Shultz & Smith, PC

(57) ABSTRACT

An apparatus for heating and impelling a fluid may comprise a housing, and an air heating impeller assembly positioned in the housing and configured to impel and heat the fluid moving through the housing. The air heating impeller assembly may comprise a support shaft, and a plurality of disks on the support shaft and spaced from each other to form fluid flow gaps therebetween. A disk may comprise a hub portion, an annular portion located radially outward from the hub portion, and a plurality of spoke portions connecting the annular and hub portions. The hub, annular and spoke portions of a disk may be formed of an integral part. A magnetic assembly may be configured to apply a magnetic field of adjustable intensity to the disks.

11 Claims, 14 Drawing Sheets

MAGNETIC AIR HEATING AN IMPELLING APPARATUS

REFERENCE TO RELATED APPLICATIONS

This application is a continuation-in-part of U.S. patent application Ser. No. 14/973,921, filed Dec. 18, 2015, which is hereby incorporated by reference in its entirety.

BACKGROUND

Field

The present disclosure relates to fluid heating apparatus and more particularly pertains to a new magnetic fluid heating and impelling apparatus.

SUMMARY

The present disclosure relates to an apparatus for heating and impelling a fluid. The apparatus may comprise a housing having an interior and at least one inlet and at least one air outlet, and an air heating impeller assembly positioned in the housing and configured to impel fluid through the housing and heat the fluid moving through the housing. The impeller assembly is rotatable with respect to the housing about an axis of rotation, and the air heating impeller assembly may comprise a support shaft extending along the axis of rotation and a plurality of disks positioned on the support shaft and spaced from each other in an axial direction to form fluid flow gaps therebetween. At least one of the disks may comprise a hub portion located at an radially-inward location on the disk and adjacent to the support shaft, and an annular portion located radially outward from the hub portion. The annular portion may be spaced from the hub portion, with an opening being formed between the hub portion and the annular portion. The disk may also comprise a plurality of spoke portions extending radially outward from the hub portion across the opening to connect the annular portion to the hub portion. The hub, annular and spoke portions of a disk may be formed of an integral part. The apparatus may include a magnetic assembly configured to apply a magnetic field of adjustable intensity to the disks.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
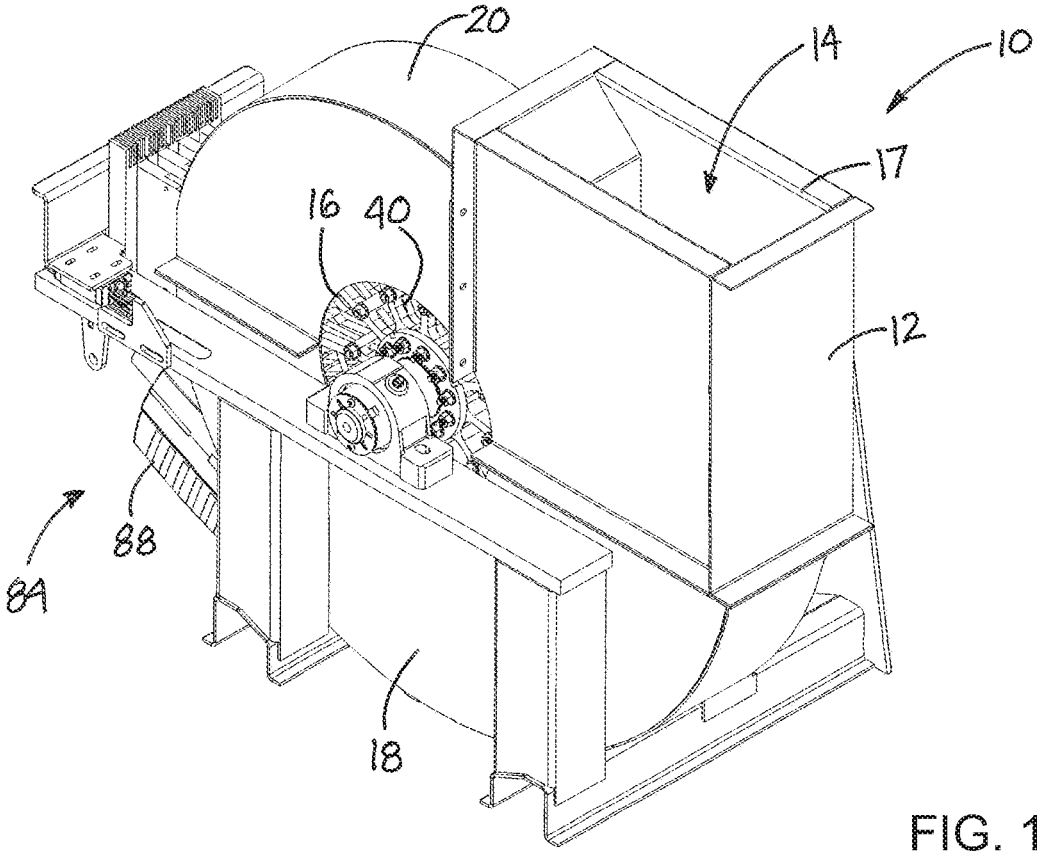
FIG. 1 is a schematic perspective view of a new magnetic fluid heating and impelling apparatus according to the present disclosure.
Figure 2:
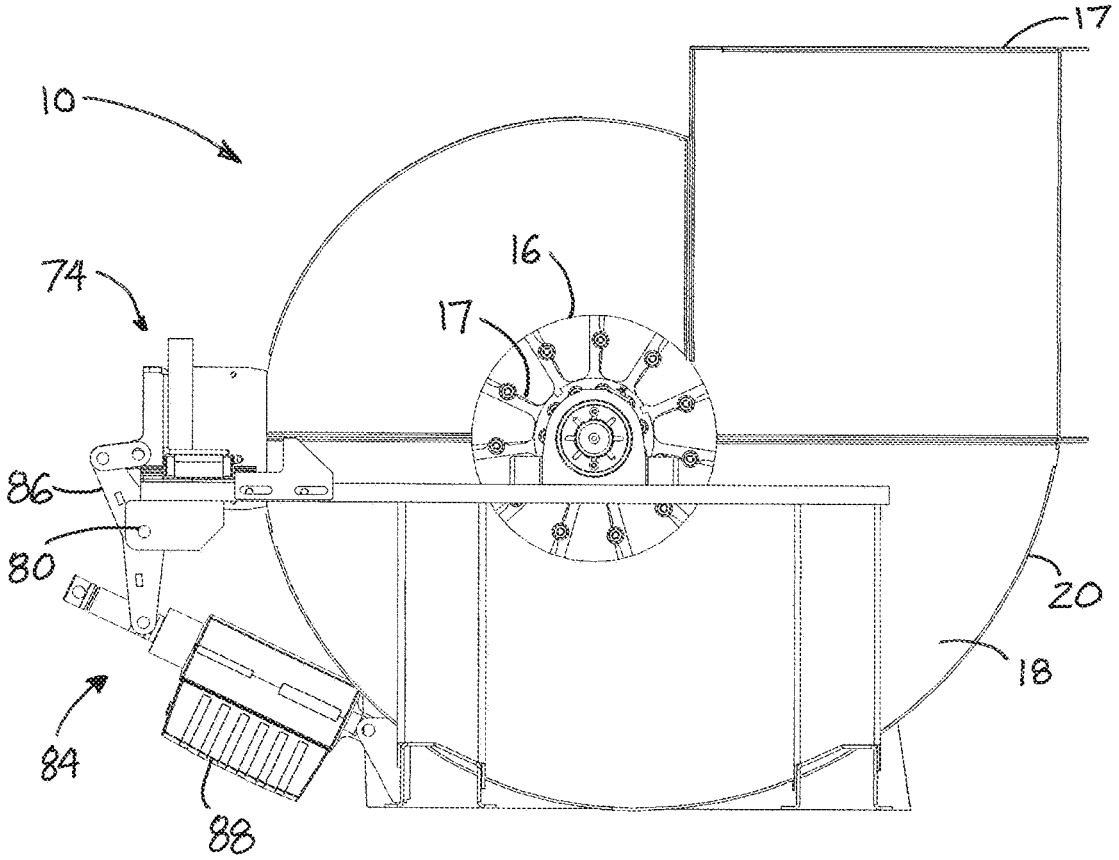
FIG. 2 is a schematic side view of the apparatus, according to an illustrative embodiment.
Figure 3:
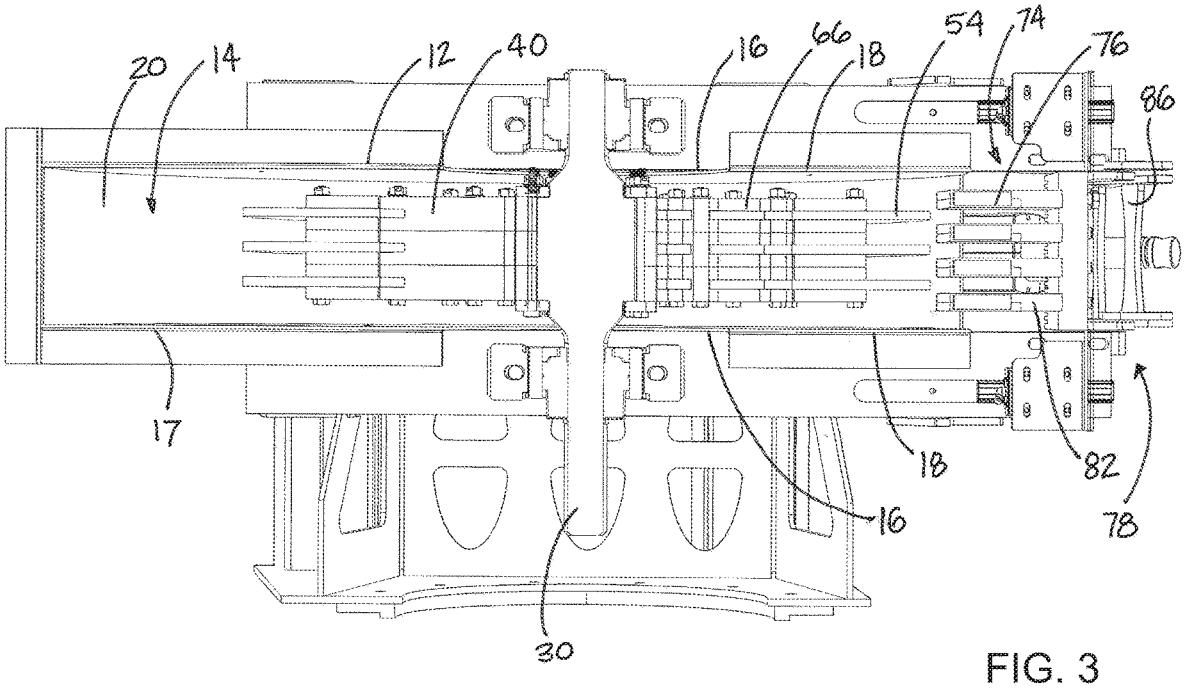
FIG. 3 is a schematic top sectional view of the apparatus, according to an illustrative embodiment.
Figure 4:
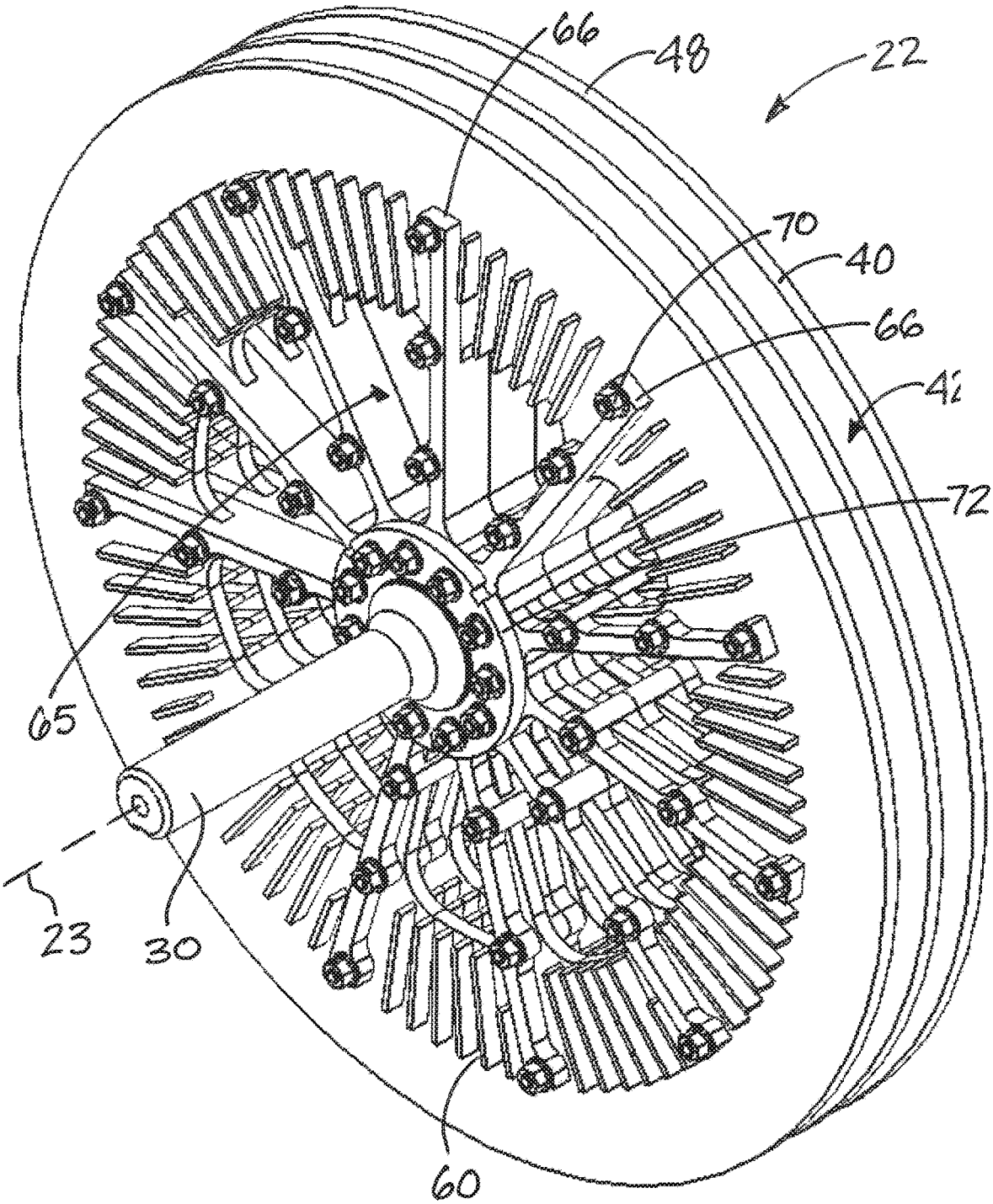
FIG. 4 is a schematic perspective view of the impeller assembly, according to an illustrative embodiment.
Figure 5:
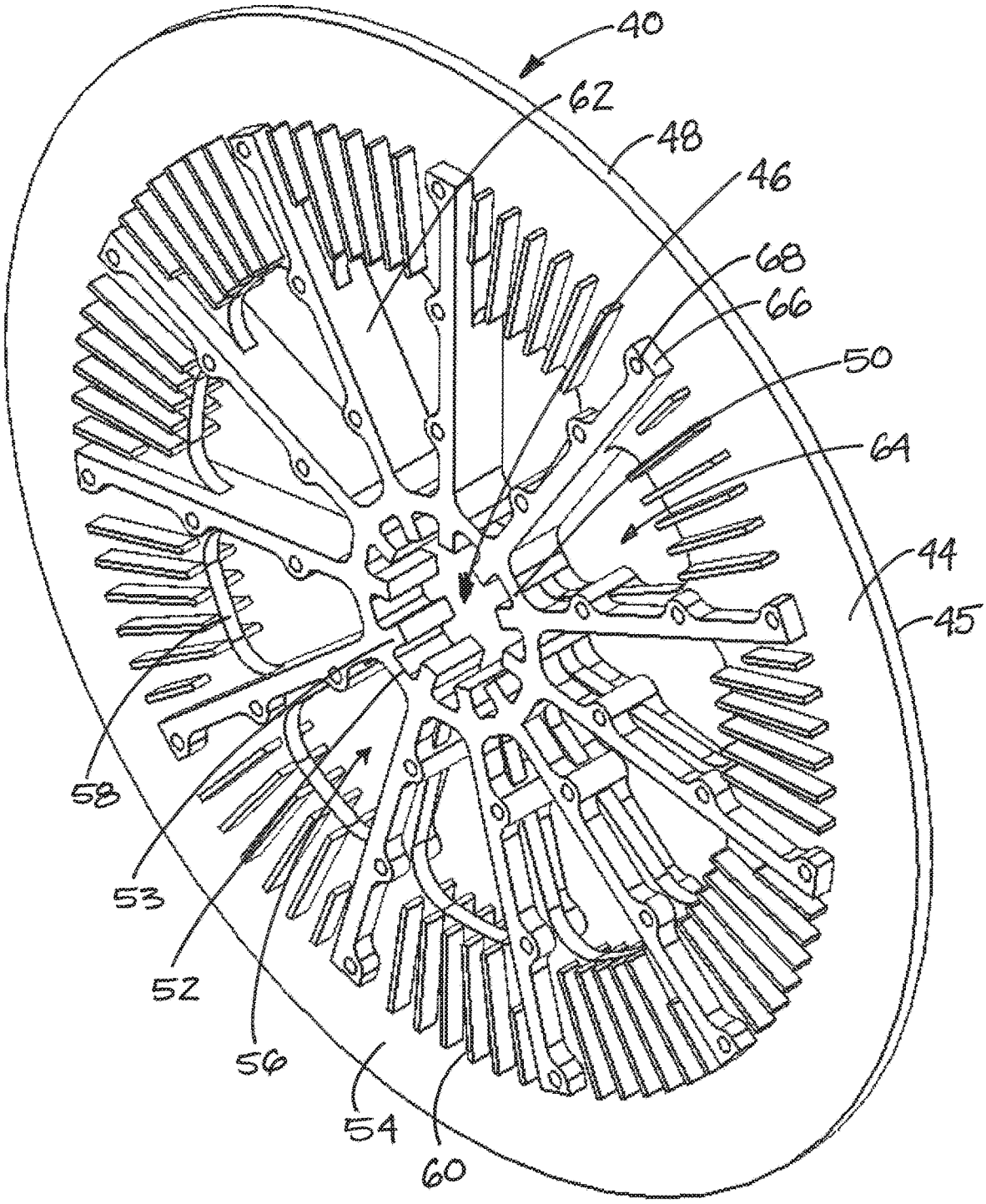
FIG. 5 is a schematic perspective view of a disk of the impeller assembly, according to an illustrative embodiment.
Figure 6:
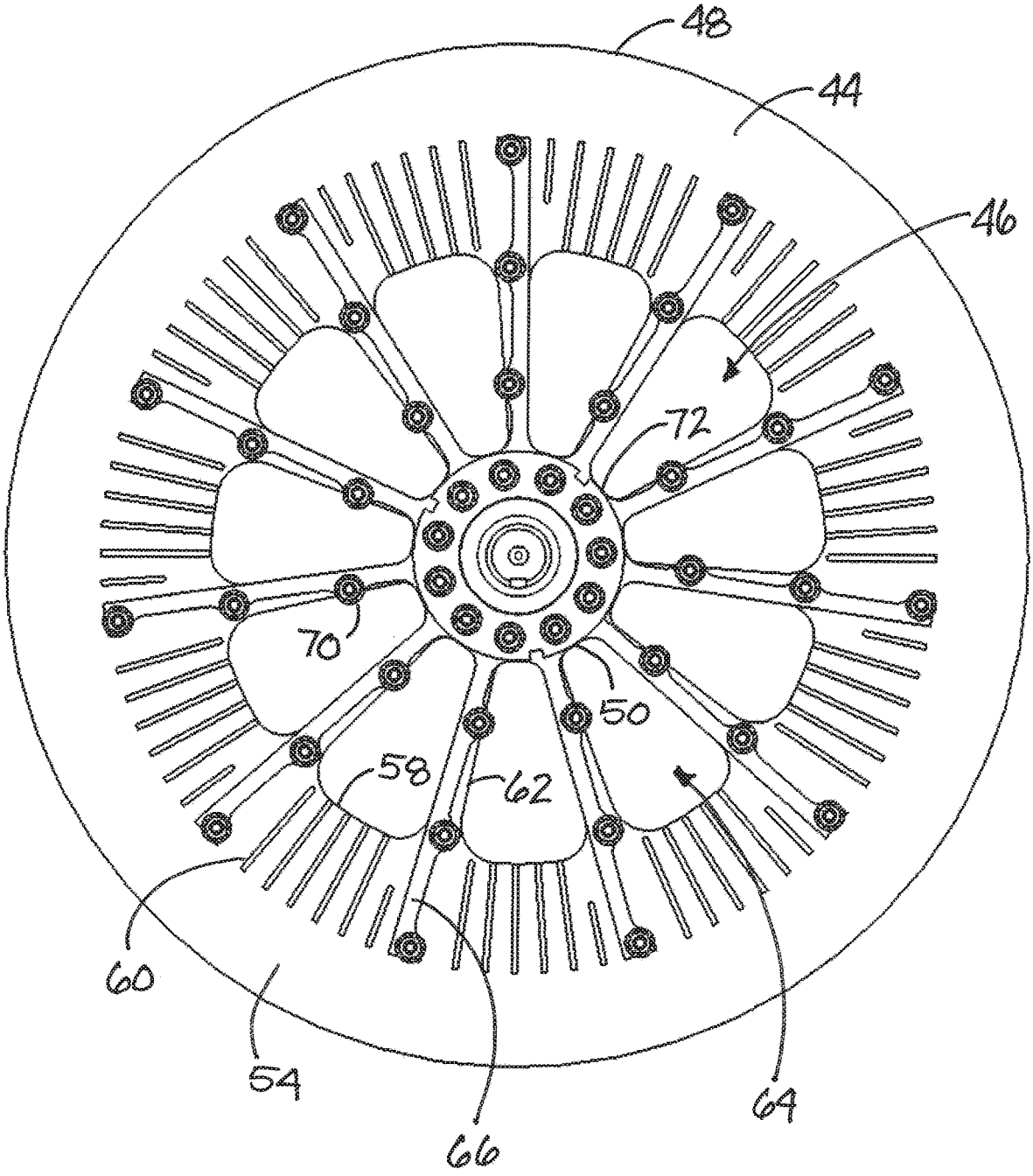
FIG. 6 is a schematic side view of a disk of the impeller assembly, according to an illustrative embodiment.
Figure 7:
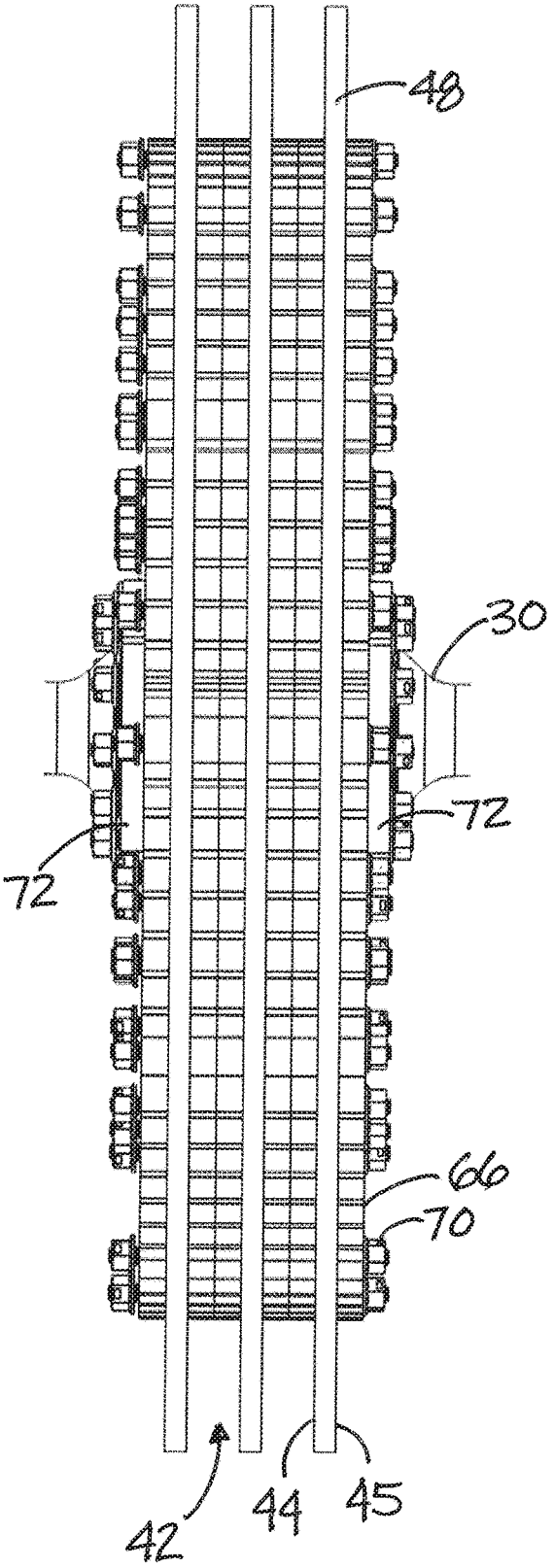
FIG. 7 is a schematic edge view of the impeller assembly, according to an illustrative embodiment.
Figure 8:
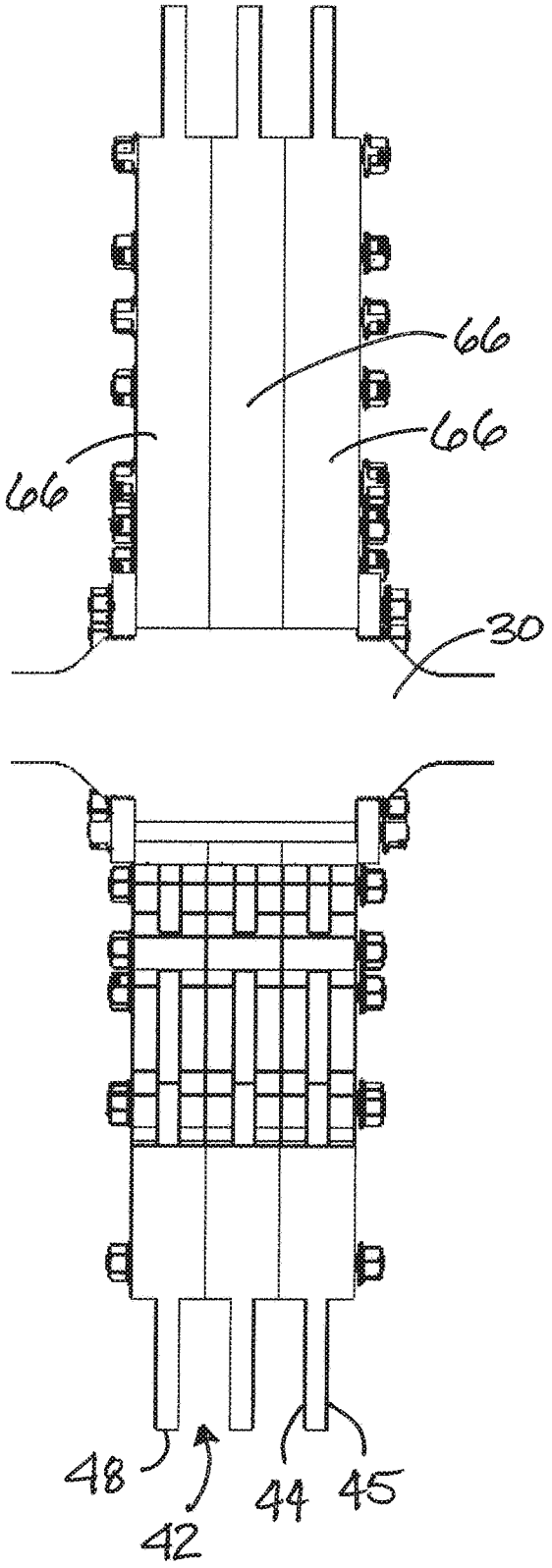
FIG. 8 is a schematic sectional view of the impeller assembly, according to an illustrative embodiment.
Figure 9:
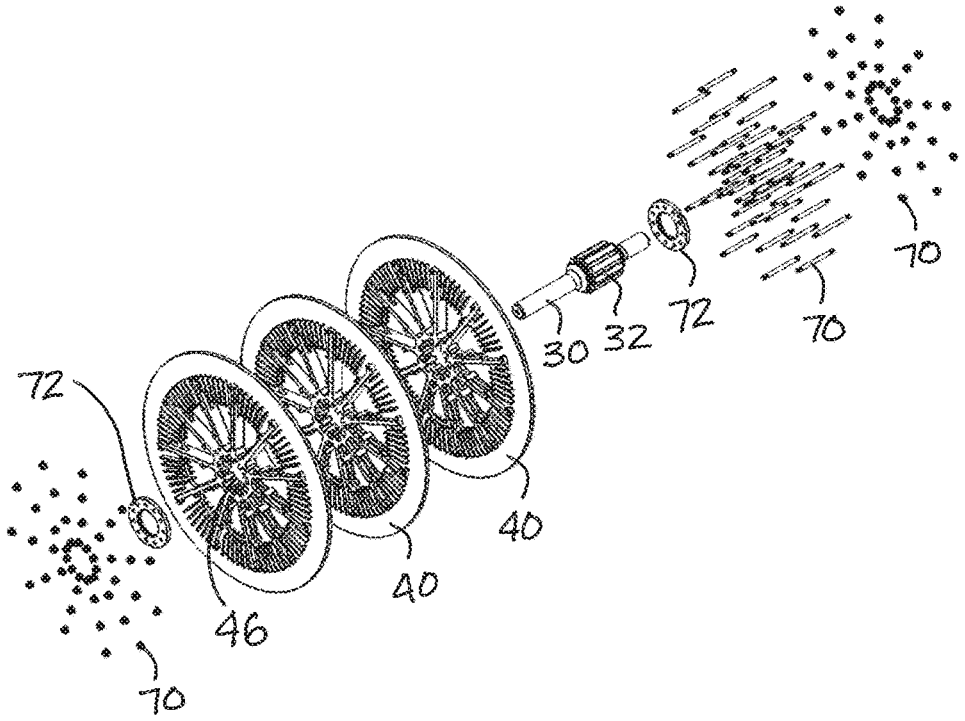
FIG. 9 is a schematic exploded perspective view of the impeller assembly, according to an illustrative embodiment.
Figure 10:
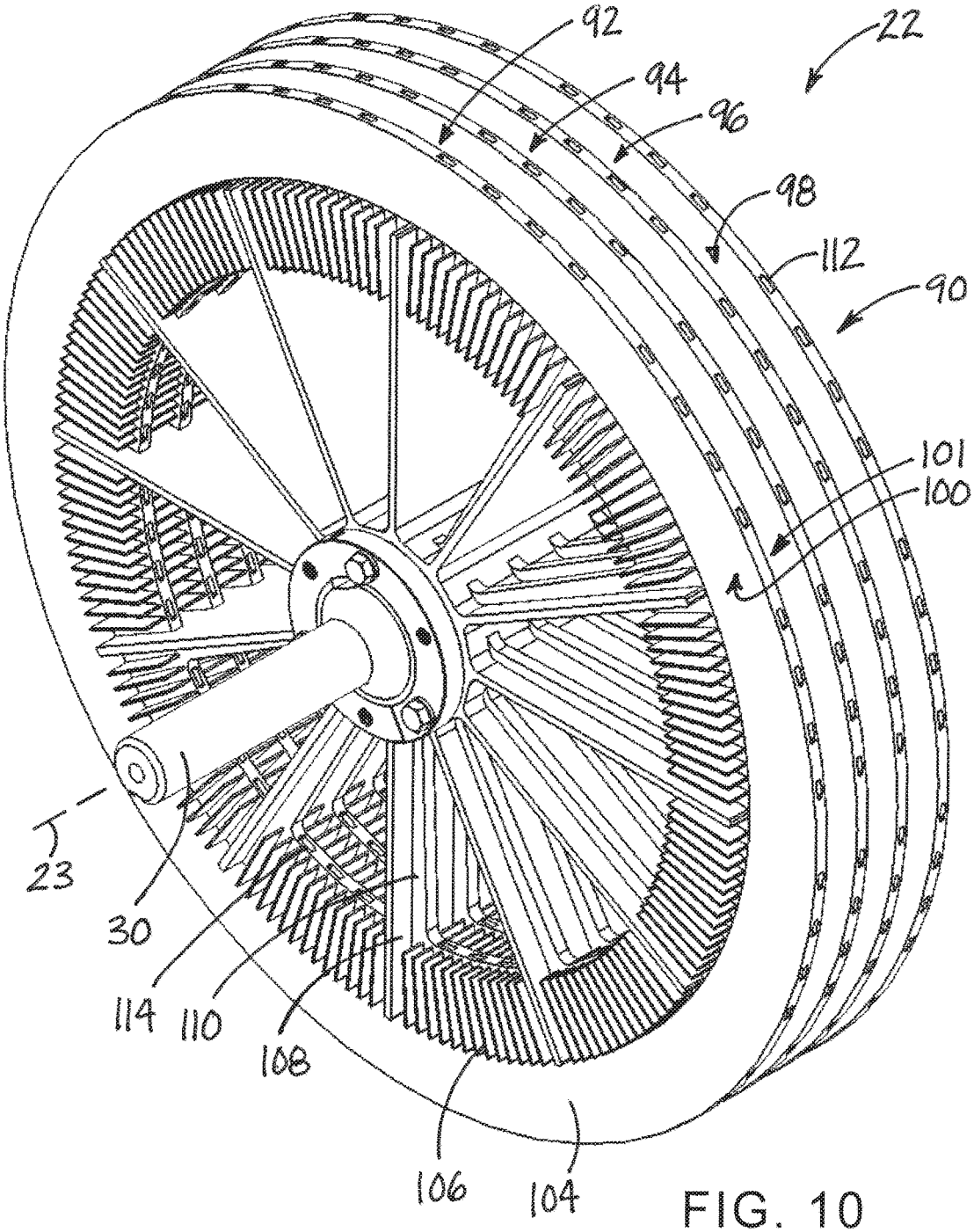
FIG. 10 is a schematic perspective view of another embodiment of an impeller assembly.
Figure 11:
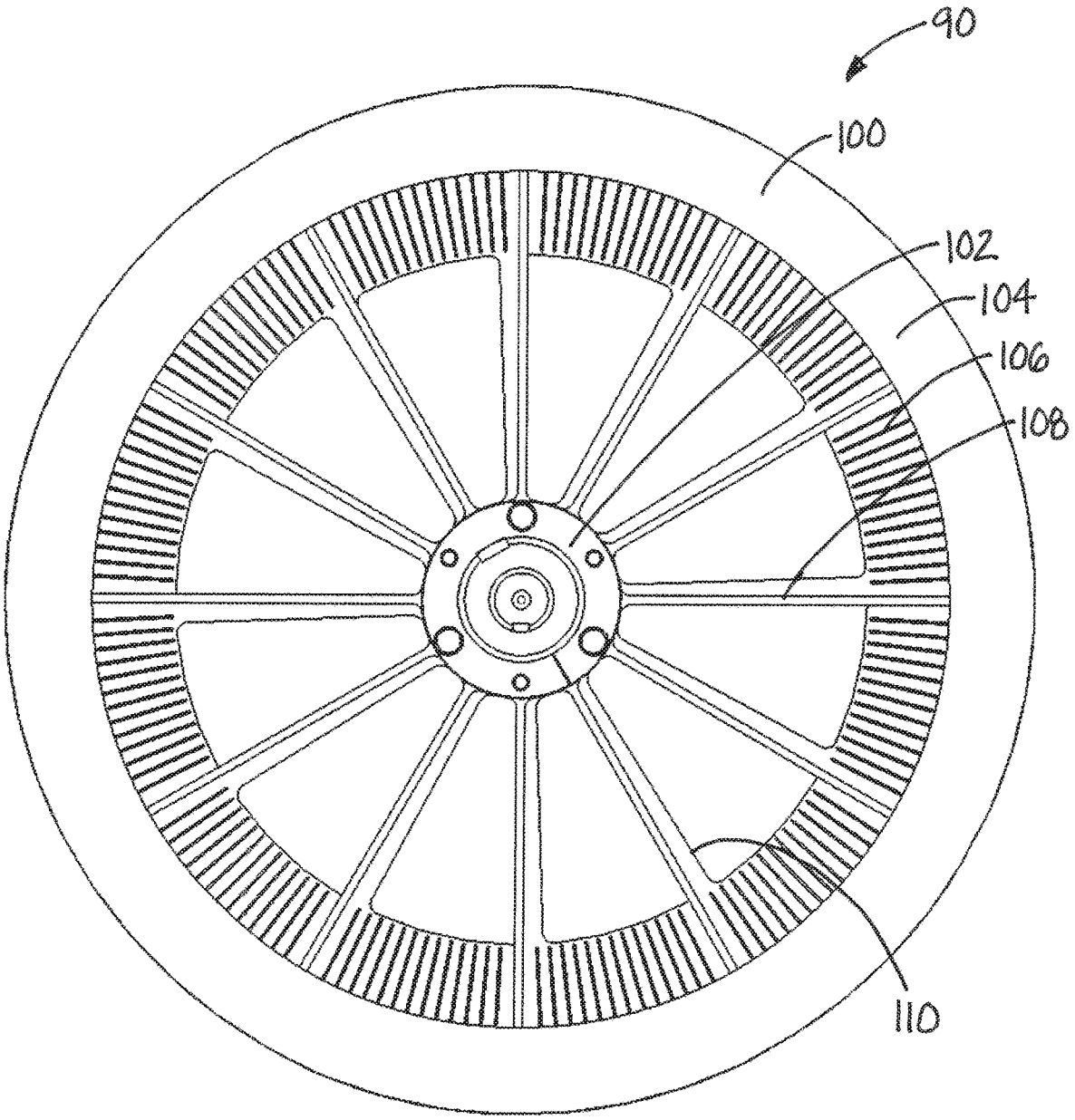
FIG. 11 is a schematic side view of the impeller assembly of FIG. 10, according to an illustrative embodiment.
Figure 12:
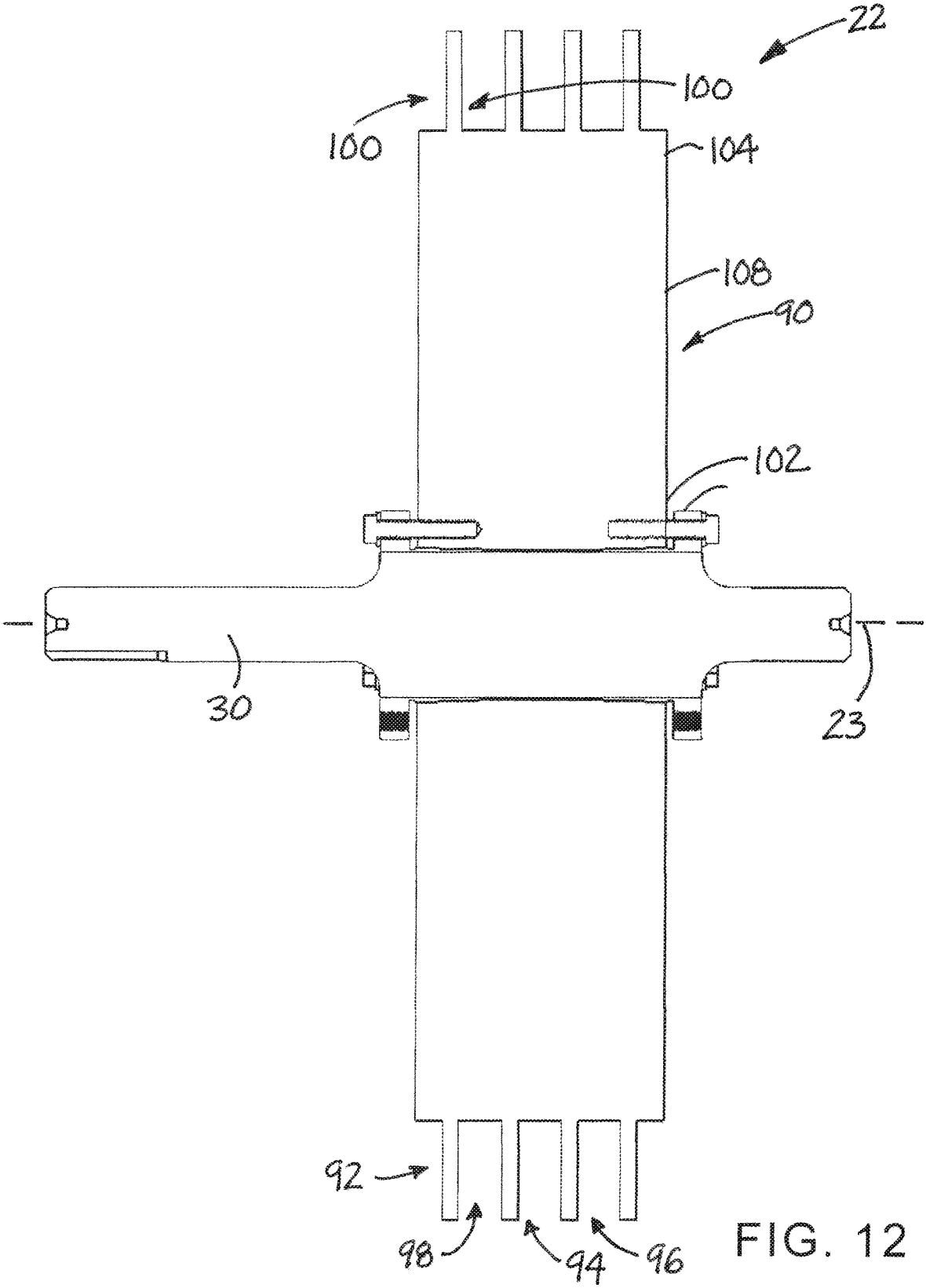
FIG. 12 is a schematic sectional view of the impeller assembly of FIG. 10, according to an illustrative embodiment.
Figure 13:
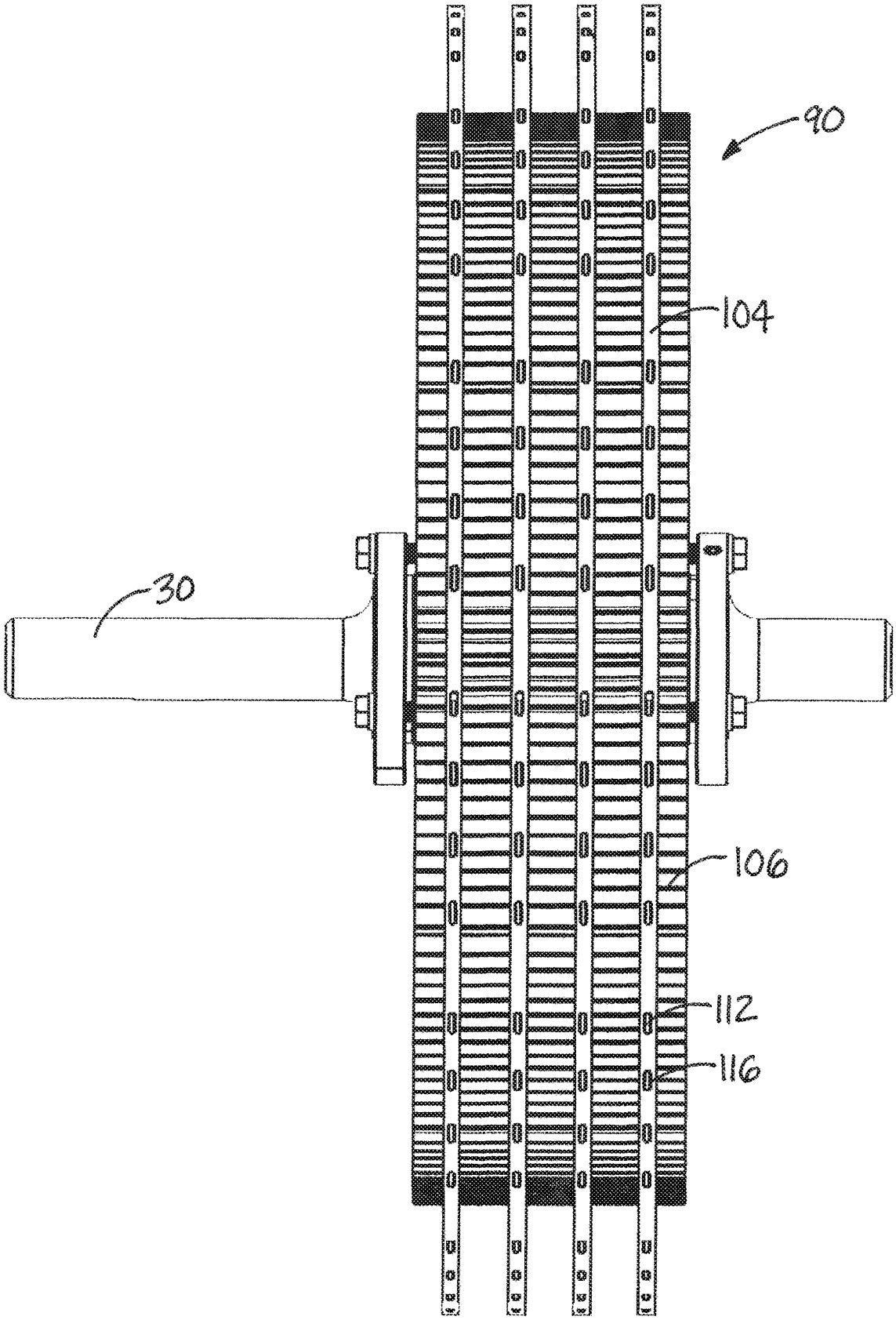
FIG. 13 is a schematic edge view of the impeller assembly, according to an illustrative embodiment.
Figure 14:
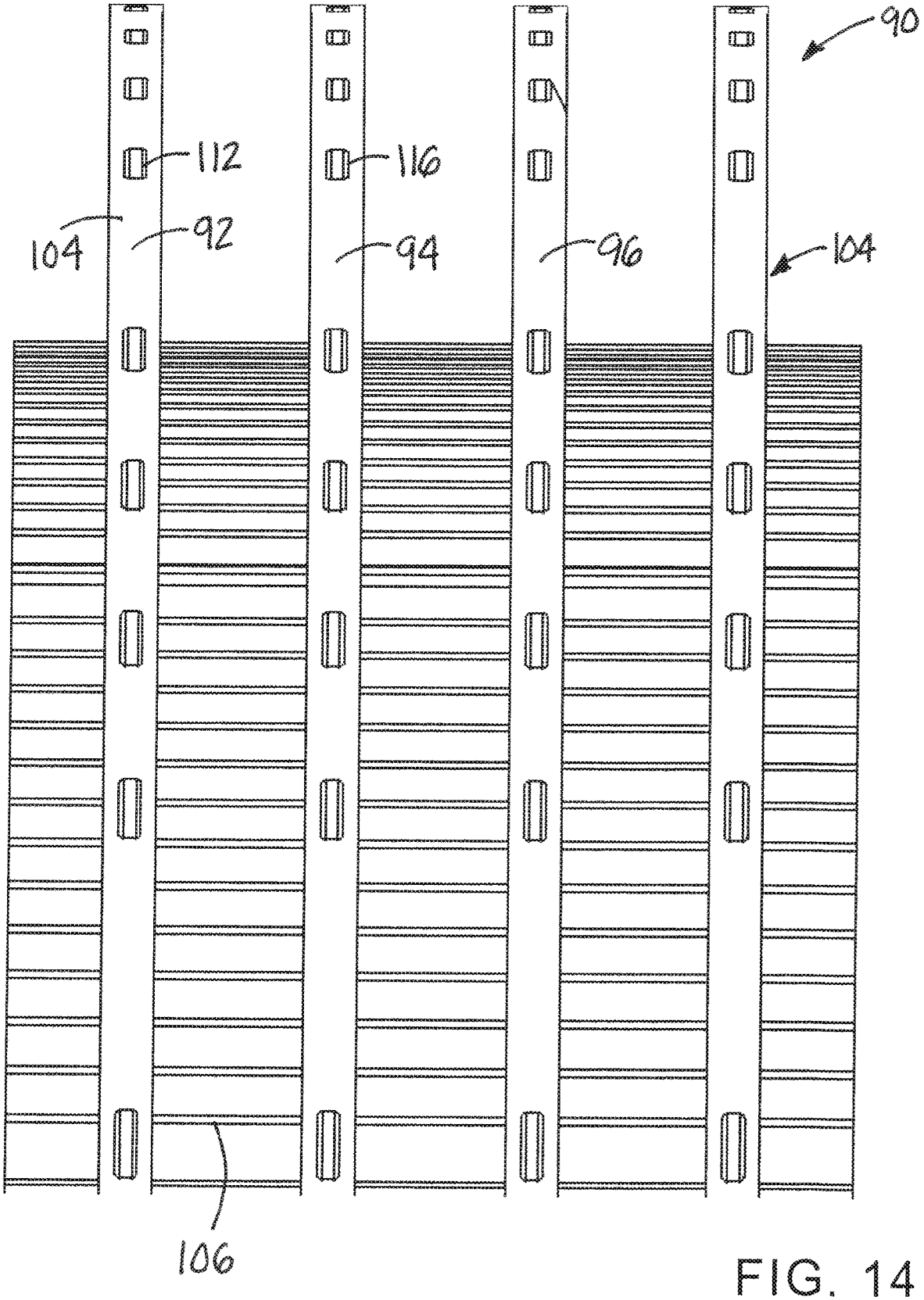
FIG. 14 is a schematic enlarged edge view of a portion of the impeller assembly, according to an illustrative embodiment.

With reference now to the drawings, and in particular to FIGS. 1 through 14 thereof, a new magnetic fluid heating and impelling apparatus embodying the principles and concepts of the disclosed subject matter will be described.

The applicant has recognized the advantages of fluid heating apparatus that utilize magnetism to generate heat through movement of magnetically-receptive materials through the magnetic field of the magnet and also employing the movement of the magnetically-receptive materials to impel fluid through and out of the apparatus. An exemplary apparatus is disclosed in U.S. Pat. No. 8,373,103, issued Feb. 12, 2013, which has a common assignee with the present application and is hereby incorporated by reference in its entirety. The applicant believes that while such apparatus are highly advantageous in efficiency and ease of use, they still may be improved upon.

In one aspect of the disclosure, a magnetic fluid heating and impelling apparatus 10 will be described that is useful for imparting heat to a fluid and also moving the fluid while the fluid is being heated. For the purposes of this description, the apparatus will be described in terms of heating and impelling air, with the understanding that virtually any fluid, such as gases and liquids, may be heating and impelled using principles of the disclosure. The apparatus 10 may include a housing 12 which defines an interior 14, and an air inlet 16 and an air outlet 17 may be formed by the housing between the interior 14 and the exterior of the apparatus. In some embodiments, the air inlet 16 includes a pair of air inlets which may be positioned on substantially opposite locations of the housing to permit air to enter the interior of the housing 12 from opposite sides of the housing. The housing 12 may have a volute shape, although other configurations may be employed, and the inlets may be located on the sides of the volute shape. The housing 12 may have a pair of opposed side walls 18, with one of the air inlets 16 being located in each of the opposed sidewalls, and a perimeter wall 20 that generally extends between the sidewalls, with the air outlet 17 may be located in the perimeter wall.

The apparatus 10 may also include an air heating impeller assembly 22 which is positioned in the interior of the housing 12. The impeller assembly 22 may be configured to impel air through the housing (e.g., between the air inlet or inlets to and through the air outlet) and also to heat the air moving through the housing, which may occur substantially simultaneously. The impeller assembly 22 is rotatable with respect to the housing about an axis 23 of rotation, and the impeller assembly may be located between the air inlet openings 16 on the side of the housing.

In greater detail, the air heating impeller assembly 22 may comprise a support shaft 30 which may extend along the axis 23 of rotation. In some embodiments, the support shaft 30 extends between the openings of the air inlets 16, and the shaft 30 may extend through the air inlets. The support shaft 30 may be supported on bearings mounted on the housing to permit rotation of the shaft 30 with respect to the housing. In some embodiments, the support shaft may have opposite end sections and a central section, with the end sections of the shaft being journalled in the bearings. The central section of the support shaft may have a plurality of grooves 32 formed thereon, with the grooves extending axially on the support shaft to form splines, and the grooves may be substantially equally circumferentially spaced about the central section of the shaft.

The impeller assembly 22 may also include a plurality of disks 40 which may be positioned on the support shaft and may extend along the support shaft in the axial direction. The plurality of disks may be spaced from each other in the axial direction to form spaces or air flow gaps 42 therebetween. Each of the disks 40 may be generally oriented substantially perpendicular to the axis 23 of rotation of the impeller assembly. Each of the disks 40 may have opposite sides 44, 45 and may have a central aperture 46 as well as an outer perimeter 48. The outer perimeter 48 may be substantially circular in shape. In some embodiments, at least a portion of the disk 40 may be formed of a conductive material, such as a magnetically conductive material, which becomes heated when moved through a magnetic field in a repeated manner.

Each of the disks 40 may include a hub portion 50 which is located at a radially-inward location on the disk. The hub portion may be positioned adjacent to the support shaft when the disk is mounted on the shaft, and the hub portion may form the central aperture 46. The central aperture 46 may be defined by an aperture edge 52 of the hub portion 50, and the aperture edge may be generally circular in shape with a plurality of inwardly-extending tabs 53 that may interlock with the grooves 32 of the support shaft.

The disks may also include an annular portion 54 which is located radially outward from the hub portion 50. The annular portion 54 may be spaced from the hub portion with an opening 56 being formed between the hub 50 and annular 54 portions. The annular portion may have an inward edge 58 which defines an inward limit of the extent of the annular portion, and the edge 58 may partially define the opening 56. At least one fin 60 may extend outwardly from at least one of the sides 44, 45 of the disk at the annular portion, and the fin may also extend in a radially outward direction as well. A plurality of the fins 60 may be formed on the annular portion, and the fins may extend from both sides 44, 45 of the disk.

Each of the disks 40 may also include a plurality of spoke portions 62 which extend between the hub 50 and annular 54 portions of the disk. The spoke portions 62 may connect the annular portion to the hub portion, and may extend radially outward from the hub portion to the annular portion across the opening 56. The plurality of spoke portions 62 may divide the opening 56 into sub-openings 64, and the sub-openings of adjacent disks in the array of disks may be substantially aligned with each other to form passages 65 into which air may pass through the disks before exiting through the air flow gaps 42 between the disks.

At least some of the disks 40 may have a spacing rib 66 extending from one of the sides 44, 45 of the disk to space at least the annular portions of adjacent disks in the array from each other to create the airflow gap 42 between the disks. The spacing rib 66 may extend radially outwardly on the disk and may be formed on the spoke portion of the disk, as well as may be formed also on the annular portion of the disk, and may also extend to the hub portion. A section of the spacing rib 66 that is located on the hub portion may be joined to an adjacent spacing rib on the disk. At least one hole 68 may be formed through the spacing rib 66 to receive a fastener 70 for fastening at least two of the disks together.

In some embodiments of the impeller assembly, the hub, annular and spoke portions of a disk are formed of an integral part, and may be machined from a single piece of material which minimizes if not eliminates any possibility that the portions of the disk become loose or separated from each other. The disks may also be fastened together by a plurality of the fasteners 70 into an integral unit that may tightly bind the spacing ribs of the disks against each other and form the disks into a unit. In some embodiments, the contouring of the first side of a disk is substantially identical to contouring on the second side of the disk, such as in the elements that protrude from the side of the disk.

The air heating impeller assembly 22 may also include a hub plate 72 which is positioned on the support shaft 30 adjacent to an end-most one of the disks, and in some embodiments a pair of the hub plates 72 are positioned on the shaft 30 on opposite sides of the plurality of disks. A plurality of fasteners may pass through the hub plates and the hub portions of the disks that are positioned between the plates to further secure the disks of the impeller assembly 22 into an integral unit.

The apparatus 10 may also include a magnetic assembly 74 which is configured to apply or produce a magnetic field of adjustable intensity with respect to the disks 40. The assembly 74 may include a plurality of magnetic elements 76 which are positioned adjacent to the disks and may be movable between a position in which the magnetic elements are located substantially between adjacent disks and a position in which the magnetic elements are not located between the disks. The magnetic assembly 74 may also include a support structure 78 for supporting the plurality of magnetic elements, and may support the magnetic elements in a manner such that the elements 76 are movable in position such that the elements may be moved into the gaps 42 between the disks. The support structure 78 may be configured to move the magnetic elements 76 between a maximum exposure position and a minimum exposure position, with the maximum exposure position being characterized by the magnetic elements 76 being moved to a position where a maximum amount of the magnetic elements are positioned in the gap 42 between the disks (thus exposing the disks to the greatest degree of the magnetic field), and the minimum exposure position being characterized by the magnetic elements 76 being moved to a position where only a minimum amount of the magnetic elements are positioned between the disks (thus exposing the disks to the least degree of the magnetic field), and in some implementations the magnetic elements may be entirely removed from the gap 42 between the disks.

In some embodiments, the support structure 78 may comprise a pivot shaft 80 which is mounted on the housing or other suitable support frame in a manner such that the shaft is able to pivot with respect to the housing. The support structure 78 may also include a plurality of mounting plates 82 which are mounted on the pivot shaft 80 and thus are movable or pivotable with the pivot movement of the pivot shaft. At least one of the magnetic elements 82 may be mounted on each of the mounting plates 82, and the mounting plates may be movable toward and away from the axis 23 of rotation of the impeller assembly 22. The support structure 78 may also include an actuator assembly 84 for pivoting the pivot shaft 80 to thereby move the mounting plates and the respective magnetic elements. The actuator assembly 84 may include a pivot arm 86 which is mounted on the pivot shaft to pivot with the pivot shaft, and an actuator 88 which acts on the pivot arm 86 to pivot the pivot arm and thus the pivot shaft. The actuator 88 may be connected to the pivot arm and the housing or a support frame to thereby pivot the pivot shaft with respect to the housing, and in some embodiments the actuator 88 may comprise a linear actuator, although other suitable actuators may be employed.

In some further embodiments, such as illustratively depicted in FIGS. 10 through 14, the impeller assembly 22 may utilize a disk unit 90 positioned on the support shaft 30. The disk unit 90 may include a plurality of disk sections 92, 94, 96 which are aligned in an axial direction of the support shaft and may form fluid flow gaps 98 which are located between the disk sections. The disk sections may have opposite sides 100, 101 with the sides of adjacent disk sections of the plurality forming the fluid flow gaps 98. At least one of the disk sections may comprise a hub portion 102 which is located at a radially-inward location on the disk section and may be located adjacent to the support shaft 30. The hub portion 102 may define the central aperture 46 through which the support shaft passes. At least one of the disk sections may also include an annular portion 104 which is located radially outwardly from the hub portion 102, and may be spaced from the hub portion with an opening being formed between the hub 102 and annular 104 portions. A plurality of fins 106 may extend from the annular portion 104 on at least one of the sides 100, 101 of the disk section toward an adjacent disk section of the plurality. The fins 106 may extend radially outwardly with respect to the axis of rotation 23 of the impeller assembly.

The disk unit 90 may have at least two adjacent disk sections of the plurality united together, and in some embodiments all of the disk sections of the disk unit may be united together. Adjacent disk sections may be united together at the respective hub portions of the disk sections, and adjacent disk sections may also be united together at the respective spoke portions of the disk sections, and adjacent disk sections may be united together at the annular portions of the disk sections. In some embodiments, the hub, annular, and spoke portions of all of the disk sections of the disk unit may be formed of an integral part. The disk unit may be formed using any suitable technology including, for example, additive manufacturing using a three-dimensional (3D) printing apparatus.

Other aspects of the disclosure include at least one vent passage 112 which may be formed in the annular portion 54 of a disc 40, or a disk section 92 of a disk unit 90. Optionally, and in some embodiments preferably, a plurality of the vent passages 112 may be formed in the annular portion at circumferentially-separated locations on the annular portion. Each vent passage 112 may have an inlet 114 at a location relatively closer to the support shaft, and an outlet 116 at a location relatively further from the support shaft than the inlet 114. In some embodiments, the vent passages 112 may be substantially linear between the inlet 114 outlet 116, and may extend in a substantially radial direction outwardly with respect to the hub portion. Optionally, the vent passages may be grouped together in groups of three to five passages, although uniform circumferential separations or spacings of the vent passages may be utilized.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps disclosed in the text and/or the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. An apparatus for heating and impelling a fluid, the apparatus comprising:

a housing having an interior and at least one inlet and at least one air outlet;

an air heating impeller assembly positioned in the housing and configured to impel fluid through the housing and heat the fluid moving through the housing, the impeller assembly being rotatable with respect to the housing about an axis of rotation, the air heating impeller assembly comprising:

a support shaft extending along the axis of rotation;

a disk unit positioned on the support shaft, the disk unit including a plurality of disk sections aligned in an axial direction of the support shaft and forming fluid flow gaps between the disk sections, at least one of the disk sections comprising:

a hub portion located at a radially-inward location on the disk section and adjacent to the support shaft;

an annular portion located radially outward from the hub portion, the annular portion being spaced from the hub portion, an opening being formed between the hub portion and the annular portion;

a plurality of spoke portions extending radially outward from the hub portion across the opening to connect the annular portion to the hub portion;

wherein the hub, annular and spoke portions of a disk section are formed of an integral part;

wherein at least two adjacent disk sections of the plurality of disk sections are fastened together at a location spaced from the hub portions of the at least two adjacent disk sections where the disk sections are positioned adjacent to each other;

wherein at least one vent passage is formed in the annular portion of a said disk section; and a magnetic assembly configured to apply a magnetic field of adjustable intensity to the disk sections of the disk unit.

2. The apparatus of claim 1 wherein the magnetic assembly comprises a plurality of magnetic elements positioned adjacent to the disk sections and a support structure configured to move the plurality of magnetic elements between a maximum exposure position in the gaps between the disk sections and a minimum exposure position.

3. The apparatus of claim 1 wherein spacing ribs extend between the disk sections to space the annular portions of adjacent disk sections from each other to create the fluid flow gap.

4. The apparatus of claim 3 wherein the spacing ribs extend radially on the disk sections and are formed on the spoke portions and the annular portions of the disk sections.

5. The apparatus of claim 1 wherein the plurality of spoke portions divide the opening of a said disk section into sub-openings, the sub-openings of adjacent disk sections being substantially aligned to form a passage through the plurality of disk sections.

6. The apparatus of claim 1 wherein a plurality of vent passages is formed in the annular portion at circumferentially separated locations on the annular portion.

7. The apparatus of claim 6 wherein the vent passages of the plurality of vent passages are grouped together in groupings of passages.

8. The apparatus of claim 6 wherein the vent passages of the plurality of vent passages are substantially uniformly spaced along a circumference of the annular portion.

9. The apparatus of claim 1 wherein the at least one vent passage has an inlet and an outlet, the vent passage being substantially linear between the inlet and outlet.

10. The apparatus of claim 9 wherein the at least one vent passage extends in a substantially radial direction outwardly with respect to the hub portion.

11. The apparatus of claim 1 wherein the at least one vent passage has an inlet at a location relatively closer to the support shaft, and an outlet at a location relatively further from the support shaft than the inlet.

* * * * *